US008689966B2

(12) United States Patent
Gambini

(10) Patent No.: US 8,689,966 B2
(45) Date of Patent: Apr. 8, 2014

(54) DEVICE FOR THE ELIMINATION OF TRIMMINGS OF ROLLS OR LOGS OF RIBBON-LIKE MATERIAL

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 75 days.

(21) Appl. No.: 13/542,414

(22) Filed: Jul. 5, 2012

(65) Prior Publication Data

US 2013/0015041 A1 Jan. 17, 2013

(30) Foreign Application Priority Data

Jul. 12, 2011 (IT) ..... MI11A001293

(51) Int. Cl.
*B26D 7/18* (2006.01)
*B26D 7/06* (2006.01)
*B26D 5/00* (2006.01)

(52) U.S. Cl.
CPC .. *B26D 7/18* (2013.01); *B26D 7/06* (2013.01); *B26D 5/00* (2013.01)
USPC ..... 198/626.1; 198/369.7; 198/418.7; 198/717; 83/104; 83/155.1; 83/167; 209/617

(58) Field of Classification Search
USPC ..... 198/626.1–626.6, 369.7, 418.7, 717, 198/734; 83/104, 149, 155, 155.1, 89, 167; 209/617
See application file for complete search history.

(56) References Cited

U.S. PATENT DOCUMENTS

| | | | | |
|---|---|---|---|---|
| 5,458,033 | A * | 10/1995 | Wierschke | 83/104 |
| 5,475,917 | A * | 12/1995 | Biagiotti | 29/822 |
| 6,371,304 | B2 * | 4/2002 | Gambini | 209/620 |
| 6,820,750 | B2 * | 11/2004 | Gambini | 209/681 |
| 2001/0022285 | A1 * | 9/2001 | Gambini | 209/698 |

(Continued)

FOREIGN PATENT DOCUMENTS

| | | |
|---|---|---|
| EP | 1281487 A2 | 2/2003 |
| EP | 1386701 A1 | 2/2004 |

(Continued)

OTHER PUBLICATIONS

Italian Search Report Dated Jan. 14, 2012.

(Continued)

*Primary Examiner* — Mark A Deuble
(74) *Attorney, Agent, or Firm* — Hedman & Costigan, P.C.; James V. Costigan; Kathleen A. Costigan

(57) ABSTRACT

A device for the elimination of trimmings of rolls or logs of ribbon-like material associated downstream with a shearing machine of at least one roll or log (11), fed by a feeding plane (13) of rolls (10) and head and/or tail rolls (24), consecutively. The device comprises a conveyor group (14) for carrying the rolls (10) and eliminating the head and/or tail rolls (24,24'), wherein the feeding plane (13) comprises rests (15) and the conveyor group (14) comprises flaps (21), both shaped, facing each other and spaced between each other to define central longitudinal openings (16 and 22) for the passage of pushers (17) which allow at least one roll or log (11) to advance; the conveyor group (14) having chains (20) on which flaps (21) are positioned, and having a length of chains (20) without flaps (21) that define a movable opening (23) between adjacent chains.

6 Claims, 8 Drawing Sheets

(56) References Cited

U.S. PATENT DOCUMENTS

| | | | | |
|---|---|---|---|---|
| 2003/0167887 | A1* | 9/2003 | Butterworth | 83/27 |
| 2004/0020343 | A1* | 2/2004 | Gambini | 83/869 |
| 2012/0204691 | A1* | 8/2012 | Gambini | 83/84 |

FOREIGN PATENT DOCUMENTS

| | | | |
|---|---|---|---|
| JP | 06-015599 | A | 1/1994 |
| WO | 01/62635 | A1 | 8/2001 |
| WO | 03/106122 | A1 | 12/2003 |
| WO | 2005/056255 | A1 | 6/2005 |

OTHER PUBLICATIONS

Italian Written Opinion With Reasoned Statement in English Dated Jan. 14, 2012.

* cited by examiner

DEVICE FOR THE ELIMINATION OF TRIMMINGS OF ROLLS OR LOGS OF RIBBON-LIKE MATERIAL

The present invention relates to an improved device for eliminating trimmings of rolls or logs of ribbon-like material, which can be associated in particular with a shearing machine.

In the field of the production of rolls or similar items of tissue paper and/or toilet paper, after forming the rolls of paper wound onto rods or cores having a preselected diameter and a certain height, they are cut to size.

When cutting-to-size, single rolls are produced, which are ready for distribution and direct use on the part of the end-user.

In the current technique known to the Applicant, the predetermined cutting-to-size of these rolls to be distributed is effected on shearing machines which receive, for example, a series of logs and cut them into a plurality of shorter rolls consecutively, each having the required dimensions. This operation on shearing machines which use rotating blades transforms the single log which is moving forward into a plurality of pieces of sections having the required size.

This operation forms sections having an incorrect size both at the head end of the single log or roll and at the tail end, which cannot be used as they are rolls having a limited length. These sections must therefore be eliminated before packaging to avoid creating difficulty in the final operation.

After various relatively invalid solutions, the Applicant conceived a device, object of patent EP 1281487 B1 which envisages, downstream of a feeding plane, a ring-closed conveyor, which moves around pulleys, which receives both the rolls cut-to-size and the head and/or tail sections or rolls. The conveyor comprises an opening having a dimension at least equal to that of the diameter of a log into which these head and/or tail sections or rolls fall, thanks to a synchronization of the parts in movement.

This solution works excellently but makes the movement of the rolls complex and costly to allow them to pass or fall into the opening.

Although these devices function excellently and essentially correctly, they require a complex construction of machine parts such as pushers, blocks, trippings, which in any case must undergo a complex synchronization. There must also be a set-up of all the accessory parts necessary for both pushing the rolls and sections and also for transporting the former and eliminating the latter.

An objective of the present invention is therefore to provide a device for eliminating the trimmings of rolls or logs of ribbon-like material which can be associated with a shearing machine which solves the technical problems and drawbacks previously indicated.

A further objective of the invention is to provide a device for eliminating the trimmings of rolls or logs of ribbon-like material which allows a continuously correct elimination of the head and tail trimmings of the starting logs or rolls.

Another objective of the invention is to provide a device for eliminating the trimmings of rolls or logs of ribbon-like material which is extremely simple to construct and easy to use, in particular with respect to the conveyor which causes the advancing of the rolls and head and tail trimmings.

Yet another objective of the invention is to provide a device for eliminating trimmings that can follow the high operating rhythms of the shearing machine, and at the same time having a simple structure which requires very few synchronizations.

The sheared rolls must move forward without any obstacles and the advancing means themselves must not create synchronization problems and/or interference with the conveyor.

In view of the above objectives, according to the present invention, an improved device has been conceived, for eliminating the trimmings of rolls or logs of ribbon-like material having the characteristics specified in the enclosed claims.

The structural and functional characteristics of the present invention and its advantages with respect to the known art will appear more evident from the following description referring to the enclosed drawings, which, among other things, show a schematization of an embodiment of an improved device for eliminating the trimmings of rolls or logs of ribbon-like material produced according to the same invention. In the drawings.

Figure 4A:
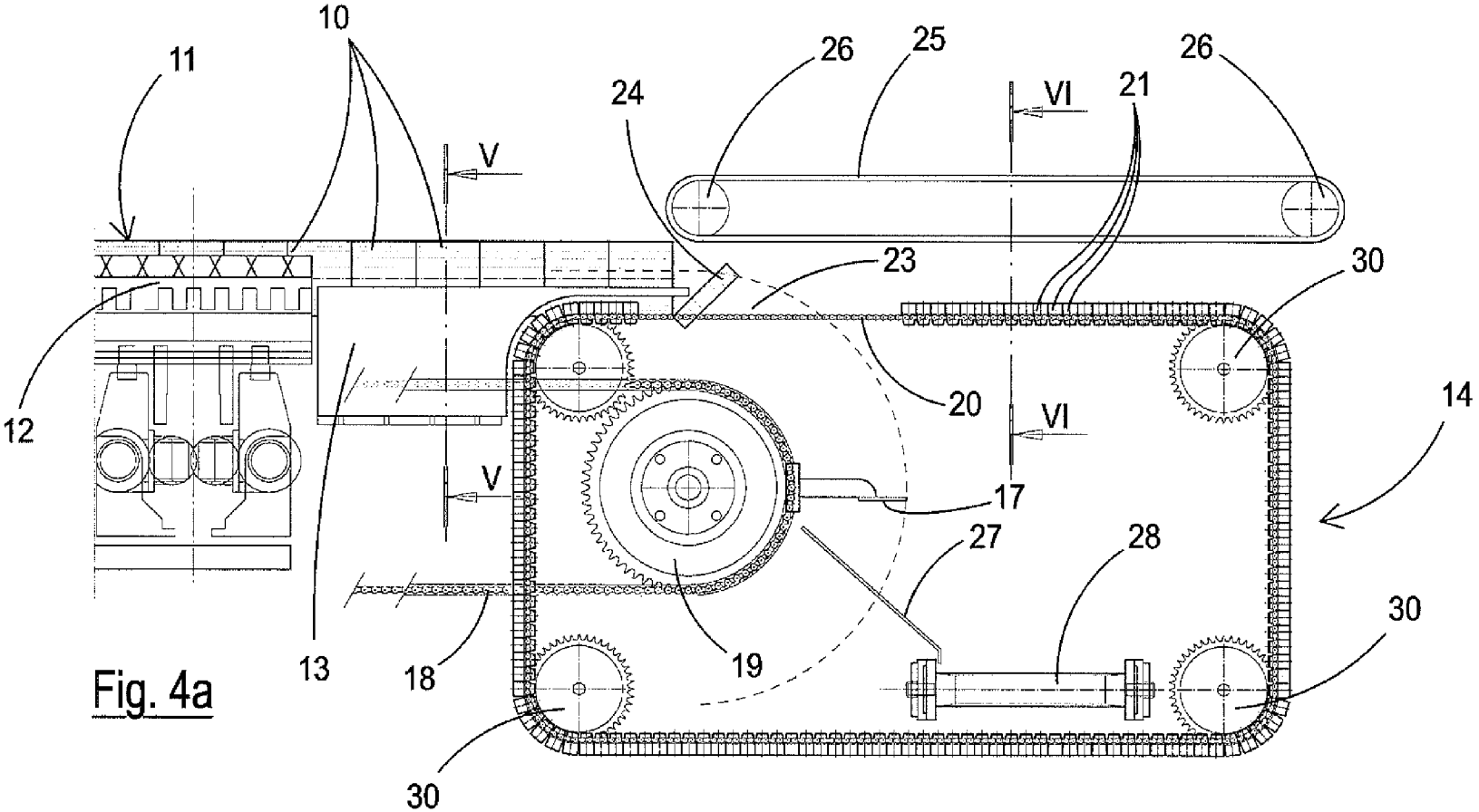
Figure 4B:
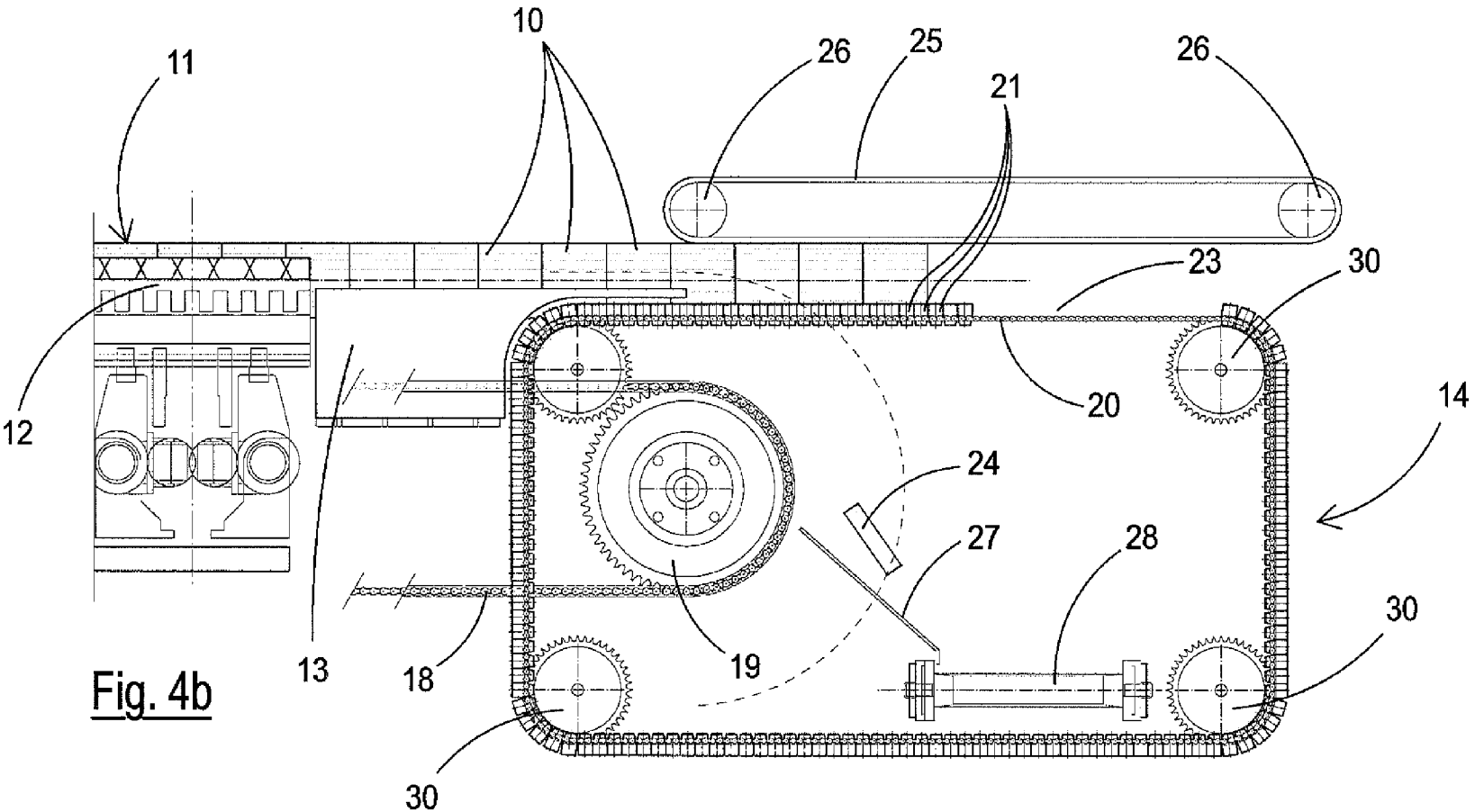
Figure 4C:
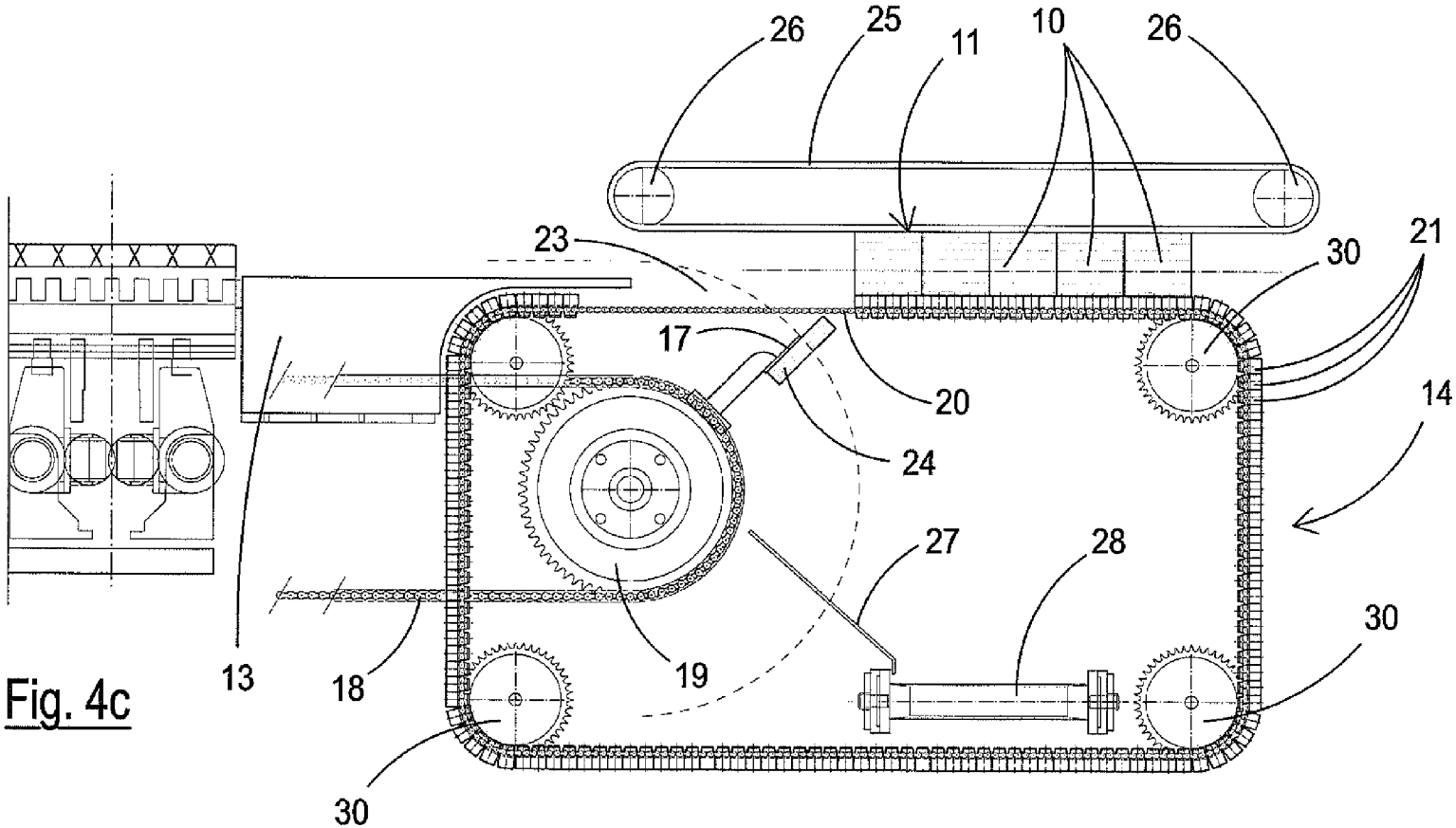
Figure 5:
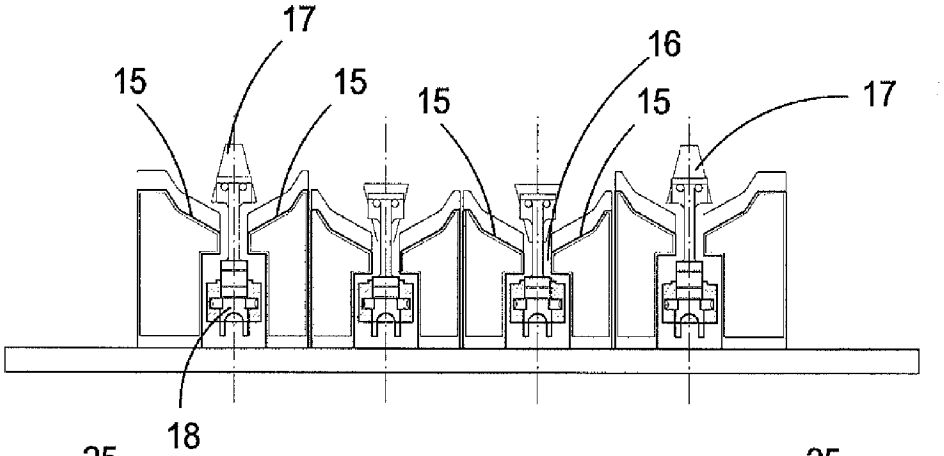
Figure 6:
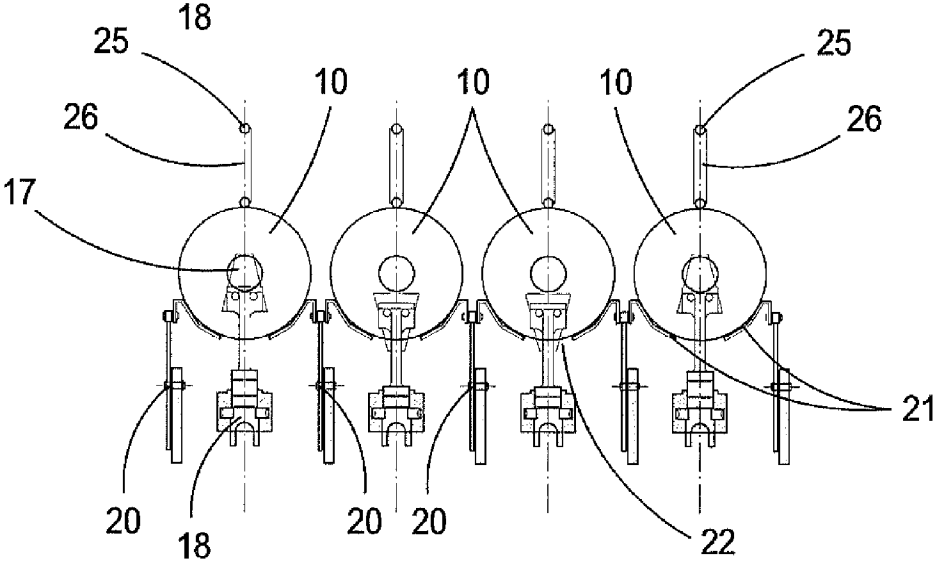
Figure 7:
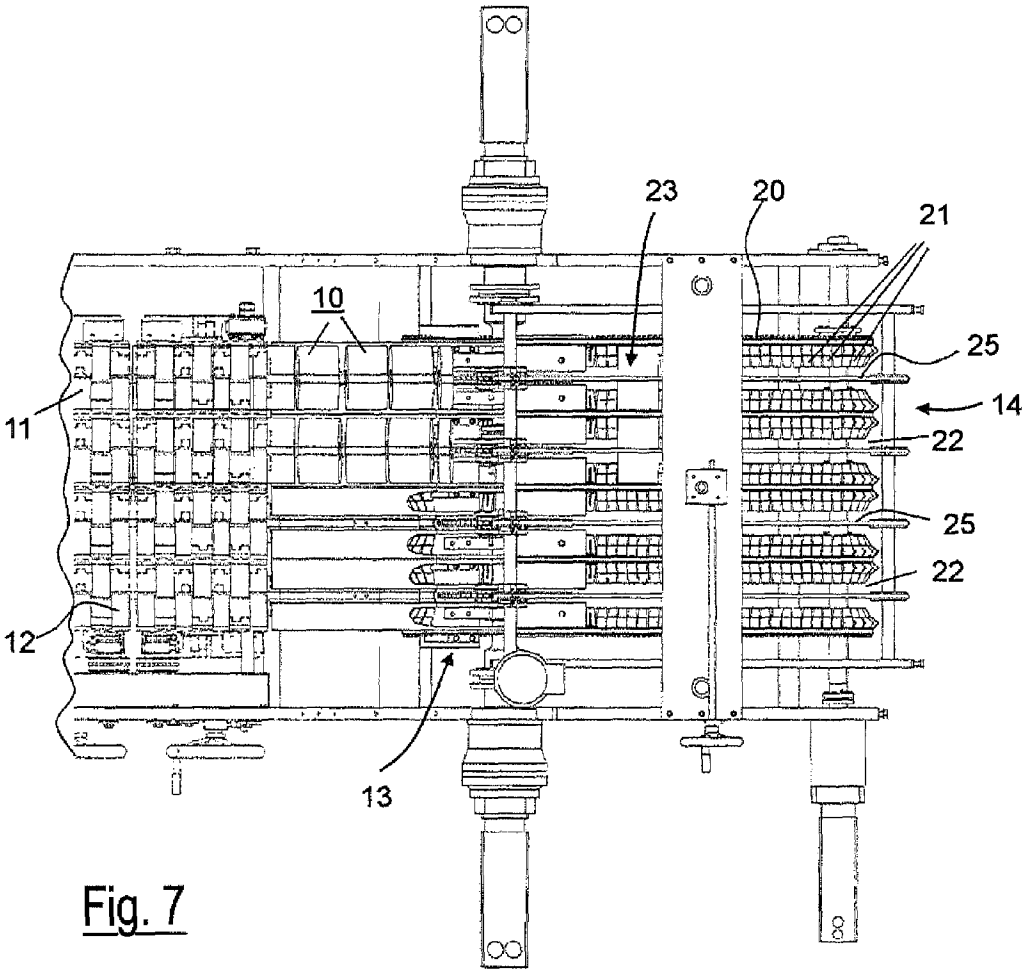

FIGS. 4*a*, 4*b* and 4*c* are raised, partially sectional side views of different activation phases of the device for eliminating trimmings of the invention;

FIG. 5 is a section according to the traces V-V of FIG. 4*a* of some details of the device;

FIG. 6 is a section according to the traces VI-VI of FIG. 4*a* of some details of the device;

FIG. 7 is a plan view from above of the device for eliminating trimmings of the present invention.

Figure 1:
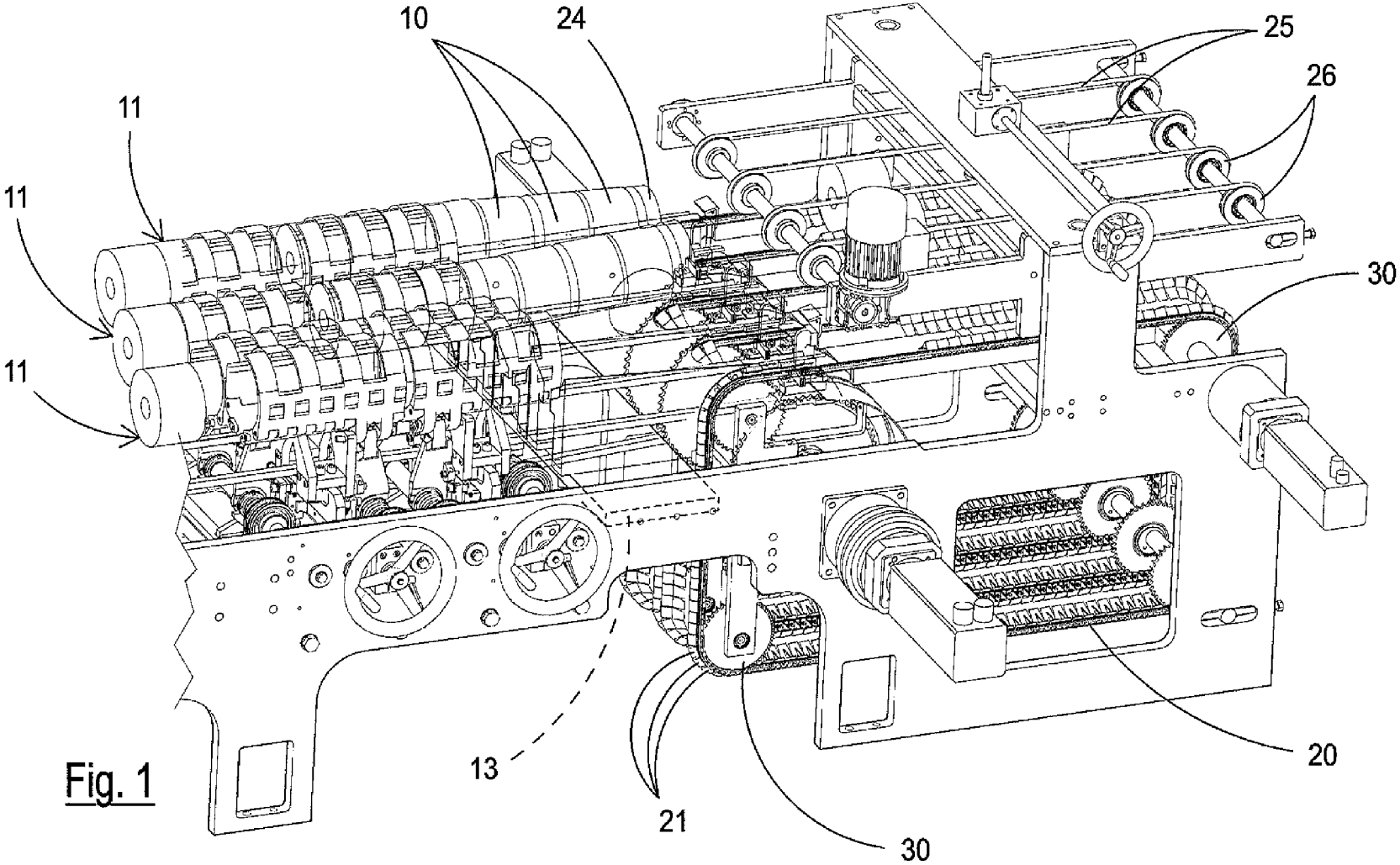
FIGS. 1 and 2 show partial perspective views from below and above of a device for eliminating the trimmings of rolls or logs of ribbon-like material produced according to the present invention associated with a machine.
Figure 2:
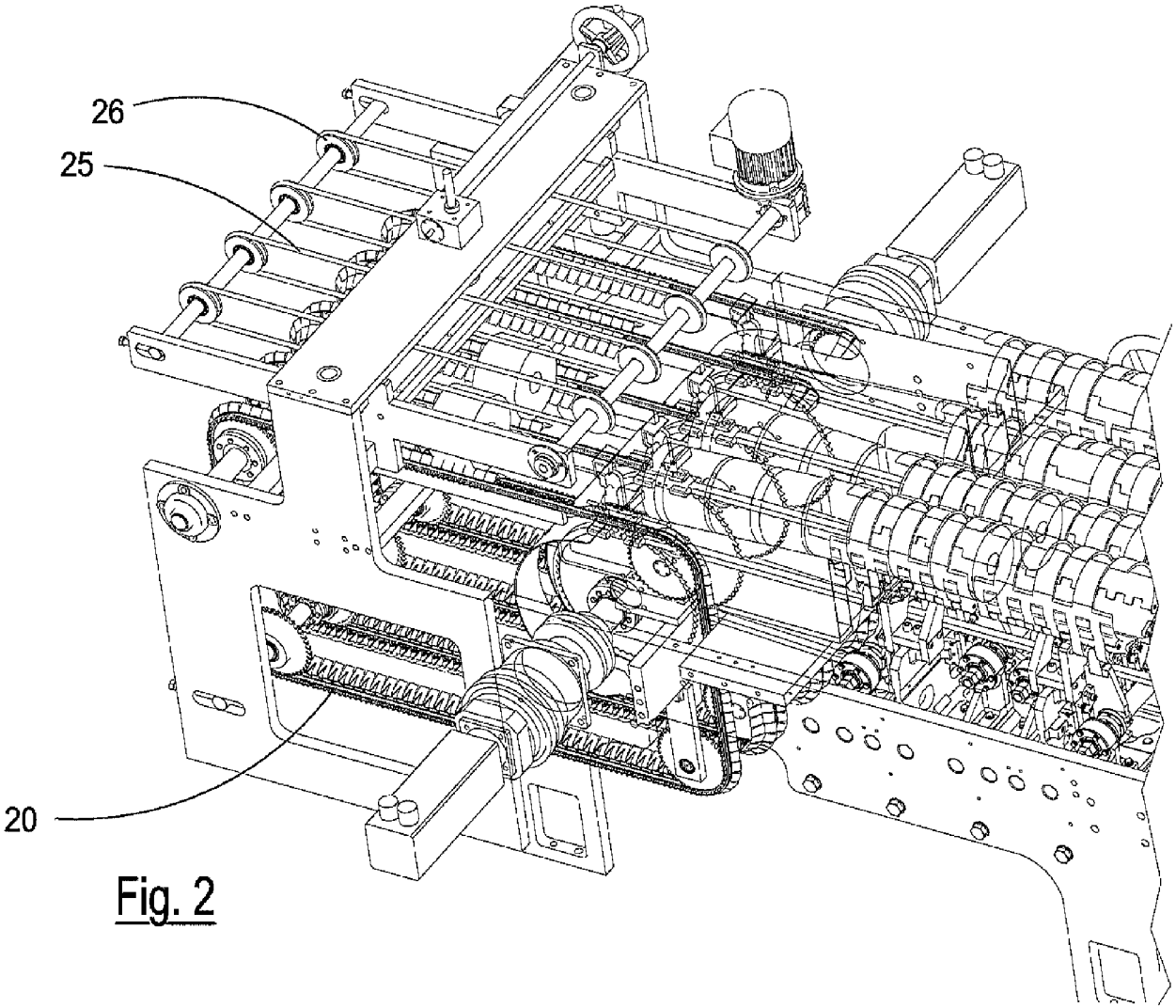
Figure 3:
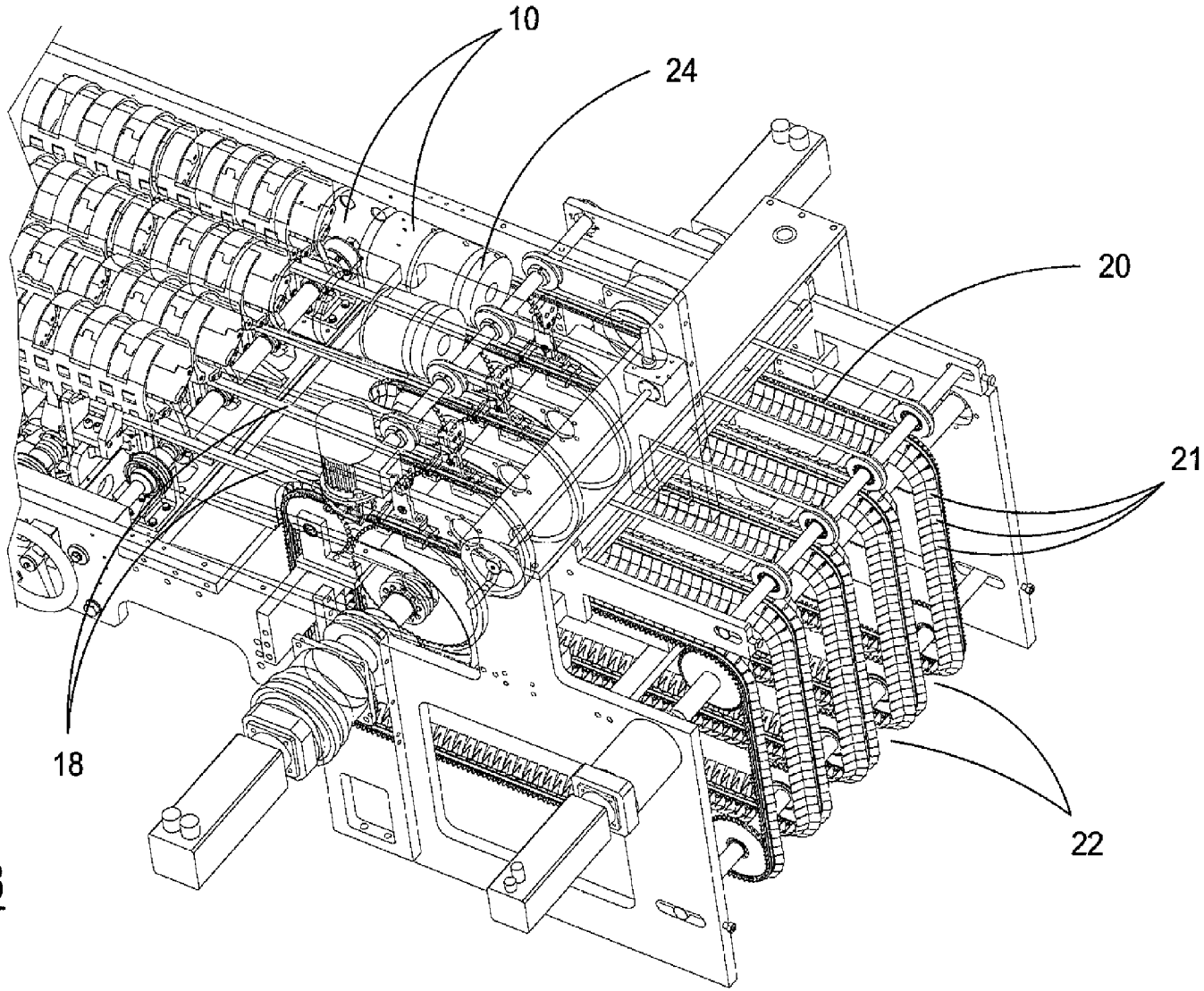
FIG. 3 shows a perspective view of the outlet part of the device for eliminating trimmings of the invention.

With reference to the figures, these illustrate an improved device for eliminating the trimmings of rolls or logs of ribbon-like material, in particular associated with a shearing machine, both positioned in line as is clearly visible in FIGS. 1 to 3.

The device can be produced for treating at least one roll or log 11 formed in the rewinding machine of the plant, but in general, there are various arrival lines of single logs 11 adjacent to each other. It is this more complex embodiment that will be described and illustrated.

A series of presses 12 are in fact envisaged upstream, which act to keep the single logs 11 adjacent during the action of the shearing blades (not shown).

Immediately after this group, there is a connection or feeding plane 13 towards a subsequent conveyor group 14.

More specifically, as shown in the section of FIG. 5, the connection plane consists of a series of adjacent channels each comprising, in section, two shaped rests 15. The shaped rests 15 face each other and are spaced between each other to define a central groove 16 in which pushers 17 run. The shaped rests 15 have a rounded form facing downwards forming the side wall and bottom of sliding cradles.

The pushers 17 are integral with a series of chains 18 which move in a ring-closed circuit between pairs of toothed pulleys 19, of which only one is shown.

The pushers 17 push forward first of all the single log 11 and subsequently the rolls 10 consecutively, when the blades (not shown) have intervened.

These chains 18 penetrate the conveyor group 14 for a certain length. More specifically, as shown in the various figures, it can be seen that each chain 18 is inserted between pairs of additional chains 20, also ring-wound around pulleys 30, forming part of the conveyor group 14.

The additional chains 20, as better shown in FIGS. 1 and 6, carry flaps 21 shaped downwards. In this way, flaps 21 of adjacent flanked chains 20 form a composite support which comprises an opening or groove in its interior as the flaps 21 facing each other are suitably spaced allowing the passage of the pushers 17.

The flaps 21 have a rounded form facing downwards forming the side wall and bottom of conveyor cradles.

The flaps 21 are not positioned for the whole length of the additional chains 20, but are absent for a short length. In this way, a movable opening 23 is defined, between adjacent chains 20, which allows whatever arrives, pushed inside the series of adjacent channels defined by the pairs of facing shaped rests 15, to fall.

The presence of openings 16 between the facing shaped rests 15 and openings 22 between pairs of flaps 21 of additional adjacent chains 20 allows the pushers to slide freely in their interior during their ring-rotation run.

The movable opening 23, on the other hand, i.e. the missing section of facing flaps 21, created between additional facing chains 20, allows the trimmings 24, 24' to drop. Said trimmings 24, 24', in fact, are situated at the head and tail of each log 11 when cut into rolls 10 and moved forward by the pushers 17. The pushed rolls 10 advance sustained firstly by the pairs of facing shaped rests 15 and then also continue once on the conveyor group 14 as they are collected and supported by the pairs of facing flaps 21.

According to the invention, a kind of "interpenetration" is created between the facing groups. The ring-wound chains 18, in fact, carrying the pushers 17 and the chains 20 carrying the flaps 21 of the conveyor group 14 in an opposite end area, extend inside interspaces between two consecutive chains 18 or 20. A direct passage of the rolls 10 is therefore created without any problem.

The advance movement of the cut rolls or pushers 17 is synchronized with the rotation movement of the chains 20 of the conveyor group.

The synchronism is obtained so that, in relation to the length of the log, the advance rates of the chains 18 and 20 are correlated.

This correlation allows the missing section of flaps 21 to be brought in correspondence with the end portion of the connection plane or shaped rests 15 when the head or tail trimmings 24, 24' arrive. In this way, the trimmings 24, 24' fall through the enlarged openings 22 into motorized underlying collection containers or chutes (not shown).

In a very simple minor embodiment, this movable opening 23, or missing section of facing flaps 21, moves with the movement of the additional chains 20 as the chains are constructed almost as long as a complete log, before cutting. In the more sophisticated and more widely-used embodiment, illustrated herein, the conveyor group 14 and pushers 17 are motorized with the possibility of having varying rates specifically in relation to the length of the logs being produced and cut.

Above the conveyor group 14, belted accompanying elements 25 are envisaged, suitably positioned and spaced, also wound ringwise around end pulleys 26 and suitably motorized.

In this way, the rolls 10 positioned consecutively, are kept in contact with the underlying conveyor group 14 as it advances.

A very synthetic summary is again provided hereunder to clarify the functioning of the device for the elimination of trimmings 24, 24' of logs 11 of ribbon-like material which can be associated downstream with a shearing machine.

A rewinding machine, known per se, produces a series of logs 11 which are suitably stored in a warehouse, in general. These logs 11 are then fed individually adjacently in a certain number (in the example shown in four rows) to the shearing machine (partially shown in its final outlet towards the device of the invention).

In this phase, the logs 11 have been cut into rolls consecutively and trimmings 24, 24' having varying and random dimensions with respect to the rolls 10, have been generated at the head and tail of each log 11 cut.

It is specifically these trimmings 24, 24' that must be eliminated before being sent for packaging.

In each channel defined by the rests 15, there is therefore initially the head trimming 24 of a log at the end of the connection plane 13. This is the case for all four channels represented in the non-limiting example.

With the further advancing of the relative pusher 17, the head trimming 24, upon reaching the end of the channels, falls (FIG. 4*a*). In particular, the head trimming 24 falls into the movable opening 23 defined in the device of the invention by the lack of flaps 21 along a section of facing chains 20.

Immediately after this fall, the conveyor group 14 which is advancing at the same rate as the rolls 10 pushed by the pushers 17, loads these rolls 10, carrying them forwards and unloading them from the connection plane 13 (FIG. 4*b*).

The conveyor group 14 then effects a turn in phase with the rolls 10 which are gradually cut until the movable opening 23 is encountered again to allow the passage of the pusher 17 of each channel which is pushing them and prior to this receives the tail trimming 24' being discharged, which falls into the movable opening 23 (FIG. 4*c*).

Finally, the conveyor group 14 waits for the arrival of the subsequent log, repeating the succession described.

In the internal part, there is a manual or even automatic extraction system of the trimmings.

In the example illustrated in FIGS. 4*a*, 4*b* and 4*c*, it can be seen how this extraction system is obtained by a chute 27 which terminates above a conveyor belt 28 (only partially shown). In particular, said chute 27 has spaced parallel openings (not shown) so as to support the trimmings 24 and 24' as they fall, but such as to allow the passage of the pushers 17 that are turning and must be allowed to continue. The conveyor belt 28 can be alternatively substituted by an extraction system of the trimmings or similar device.

It can thus be seen how a device according to the invention eliminates any complex structure of parts of the machine, for example allowing a simple and free circulation of the pushers, avoiding any possibility of interference between the parts.

Blocks, trappings and complex synchronizations for avoiding contacts are therefore unnecessary. The pushers in fact pass into the continuous central grooves or openings 16 which are formed by the arrangement of the adjacent rests 15.

The same innovative solution is obtained between facing flaps 21 where there are continuous openings or grooves 22 which also allow a free circulation of the pushers 17.

The objective mentioned in the preamble of the description has therefore been achieved.

The forms of the structure for producing a device of the invention, as also the materials and assembly modes, can obviously differ from those shown for purely illustrative and non-limiting purposes in the drawings.

The protection scope of the present invention is therefore delimited by the enclosed claims.

The invention claimed is:

1. An improved device for the elimination of trimmings of rolls or logs of ribbonlike material which can be associated downstream of a shearing machine of at least one roll or log (11), fed by a feeding plane (13) of rolls (10) and head and/or tail rolls (24), consecutively, the device comprising a conveyor group (14) for carrying the rolls (10) and eliminating the head and/or tail rolls (24, 24'), characterized in that said feeding plane (13) comprises rests (15) and said conveyor group (14) comprises flaps (21) both shaped, facing each other and spaced between each other to define central longitudinal openings (16 and 22) for the passage of pushers (17) which allow said at least one roll or log (11) to advance, said conveyor group (14) comprising chains (20) on which said flaps (21) are positioned, and comprising in the same a length of said chains (20) without said flaps (21) defining a movable opening (23) between adjacent chains which allows the passage and falling of said head and/or tail rolls (24).

2. The device according to claim 1, characterized in that said pushers (17) are situated on chains (18) wound ringwise between pulleys.

3. The device according to claim 1, characterized in that said shaped rests (15) have a rounded shape facing downwards to form the side and bottom wall of a sliding cradle.

4. The device according to claim 1, characterized in that said shaped flaps (21) have a rounded shape facing downwards to form the side and bottom wall of a sliding cradle.

5. The device according to claim 1, characterized in that chains wound ringwise (18) carrying said pushers (17) and said chains (20) carrying said flaps (21) of said conveyor group (14) in an opposite end zone extend within interspaces between two consecutive chains (18 or 20).

6. The device according to claim 1, characterized in that, above said conveyor group (14), in correspondence with said longitudinal openings (22), belted accompanying elements (25) are positioned, which maintain the consecutive rolls (10) in contact with the underlying advancing conveyor group (14).

* * * * *